US005647382A

United States Patent [19]

Lovette et al.

[11] Patent Number: 5,647,382

[45] Date of Patent: Jul. 15, 1997

[54] COMPONENT SPOOL AND SHELL PRESSURE VESSEL WITH HYDRAULIC FLUID ACTUATED PRESSURE SEALS

[75] Inventors: James Edward Lovette; Lucas Jones Conrad; John Edward Crook; Robert Eugene Grubbs, all of Winston-Salem; Wayne David Detwiler, King, all of N.C.

[73] Assignee: R. J. Reynolds Tobacco Company, Winston-Salem, N.C.

[21] Appl. No.: 673,985

[22] Filed: Jul. 1, 1996

[51] Int. Cl.[6] ..... A24B 3/18

[52] U.S. Cl. ..... 131/291; 131/296

[58] Field of Search ..... 131/291; 99/323.4; 422/242, 292; 426/447, 449, 450; 49/477.1; 285/80, 95, 101, 104, 109; 92/165 R

[56] References Cited

U.S. PATENT DOCUMENTS 4,554,932 11/1985 Conrad et al. ..... 131/291

5,469,872 11/1995 Beard et al. ..... 131/291

*Primary Examiner*—Jennifer Bahr

[57] ABSTRACT

A process and apparatus for tobacco expansion is employed for expanding tobacco at rapid throughput rates. The apparatus includes a spool and shell assembly wherein the spool is moveable into and out of the shell between loading, impregnating, and unloading positions. In the impregnating position, sealing assemblies seal the radial clearance between the spool and shell to provide a pressure vessel for tobacco impregnation. The sealing assemblies include at least one elastically deformable sealing ring and an annularly shaped axial pressure applying member to releasably impart axial pressure to the sealing ring. The axial pressure applying member receives fluid pressure from a hydraulic fluid and preferably receives additional fluid pressure from the expansion agent used to expand the tobacco.

19 Claims, 4 Drawing Sheets

COMPONENT SPOOL AND SHELL PRESSURE VESSEL WITH HYDRAULIC FLUID ACTUATED PRESSURE SEALS

FIELD OF THE INVENTION

The invention relates to a pressure vessel and to processes for high pressure fluid treatment and, preferably, processes for treating tobacco with a high pressure fluid for increasing the filling capacity of tobacco, although the process and apparatus of the invention can also be used in extraction processes, and other processes in which the treatment of a material at elevated pressure is required.

BACKGROUND OF THE INVENTION

The apparatus and process of the invention are particularly desirable in connection with tobacco expansion processes, i.e. processes for increasing the filling capacity of tobacco. Tobacco expansion processes are used to restore tobacco bulk density and/or volume which are lost during curing and storing tobacco leaf. in addition, expanded tobacco is an important component of many low-tar and ultra low-tar cigarettes.

In current commercial processes for impregnating tobacco with an expansion agent under high pressure, for example, from 200 psig and above, the pressure vessel required is quite bulky, having heavy portable lids to withstand the pressure. The seal mechanisms for the lids are specially designed to withstand the high pressures. These types of pressure vessels, which are generally referred to as autoclaves, normally have a cylindrical body portion with convex ends, one or both ends being removable to permit loading and unloading.

One goal in any process is to increase material throughput. However, most tobacco expansion processes include a high pressure impregnation step along with other steps which cannot be carried out at high pressure. This, in turn, requires that pressure be released at some point and the treated tobacco removed from the pressure vessel. As a result, the infeed and outfeed to and from the pressure treatment step is a limiting factor in improving efficiencies in high pressure tobacco treatment processes. Thus, tobacco expansion processes employing a high pressure impregnation step are limited in their throughput efficiencies by the equipment used, particularly the pressure vessel.

Specifically, in tobacco expansion processes, a volatile tobacco expansion agent is introduced into the cellular structure of the tobacco which has collapsed due to the curing process. Generally, this step is referred to as impregnation. The impregnated tobacco is then exposed to conditions causing the expansion agent to rapidly volatilize, causing the tobacco cell to expand as the compound is driven out of the cell in a gaseous or vaporous state. Volatilization of the expansion agent is accomplished by heating the impregnated tobacco in many cases or by rapidly reducing pressure in other cases. There are a number of processes which utilize these basic concepts with different expansion agents, some of which are disclosed in U.S. Pat. No. Re. 30,693, U.S. Pat Nos. 3,524,452; 3,771,533; and 4,531,529; British Patent Specification No. 1,484,536 and Canadian Patent No. 1,013,640.

The amount of pressure used to impregnate the tobacco generally depends on the particular expansion agent employed. U.S. Pat. No. 3,524,452 to Stewart et al. discloses a process in which a relatively low pressure can be used because the impregnant is normally in a condensed state at these pressures, while Canadian patent No. 1,013,640 and British Patent Specification No. 1,484,536, which disclose processes which use carbon dioxide as the impregnating compound, and require a much higher pressure to ensure that carbon dioxide is introduced into the tobacco cells in sufficient quantity to cause expansion of the cells when the impregnated tobacco is heated.

Some of the drawbacks of using any of these and other prior art high pressure systems are the bulkiness of the autoclave and lids, the difficulties with sealing the system, the special basket or container required to hold tobacco, and other problems associated with loading and unloading tobacco into and out of the pressure vessel.

U.S. Pat. No. 4,554,932 to Conrad and White, incorporated herein by reference, describes a fluid pressure treating apparatus including a tubular shell housing a spool assembly. The spool includes a cylindrical spool body portion that is preferably of relatively small diameter that extends between the two spool ends. The spool ends have a diameter greater than the spool body, but less than the inside diameter of the tubular shell. The spool is mounted for reciprocating movement between a loading position outside the shell, a treating position within the shell, and an unloading position outside of the shell. When the spool is within the shell, deformable sealing rings carried in annular grooves on the spool ends are forced radially outwardly for engagement with the interior of the shell wall. This provides a sealed, annular-shaped pressure chamber inside the shell, in the space between the spool ends and surrounding the smaller spool body. One or more ports through the shell cooperate with conduit shaped cavities extending radially into one or both spool ends and axially along the spool body, to allow input and removal of processing fluids into and from the annular space around the spool body within the shell.

U.S. patent application Ser. No. 08/163,049 filed Dec. 6, 1993, to Beard et al., entitled Tobacco Expansion Process and Apparatus, now U.S. Pat. No. 5,469,872 describes an apparatus and process for expanding tobacco at rapid throughput rates employing high pressure tobacco impregnation conditions. A preferred apparatus according to that invention employs the concepts of the pressure vessel including the spool and shell assembly of U.S. Pat. No. 4,554,932 set forth above. An improved spool assembly disclosed therein includes elastomeric sealing rings attached in annular grooves about the periphery of the end members of the spool, as well as wear rings to narrow the annular space or gap between the spool assembly and the shell. These sealing rings are integral with the wear rings and are exposed to a high pressure fluid, typically a food grade vegetable oil, on their inside circumferential surface to cause the rings to expand radially outwardly to accomplish their sealing function.

Although the spool and shell pressure vessel produces substantial time savings and improve economics in tobacco expansion, the fluid used to expand the sealing rings must be ported to the sealing rings by providing blind ports within the spool body. Moreover, the rings must be periodically replaced by removing the old rings and bonding new rings to the spool body. If the elastomeric ring pressure fluid such as vegetable oil, leaks onto the tobacco, usefulness of the tobacco in the manufacture of cigarettes is impaired. Moreover, replacement of worn sealing rings is time consuming and costly.

SUMMARY OF THE PRESENT INVENTION

This invention provides an improved spool assembly and an improved high pressure tobacco treatment process, preferably of the type disclosed in U.S. Pat. No. 4,554,932 to Conrad and White, and in the process and apparatus of U.S. patent application Ser. No. 08/163,049, filed Dec. 6, 1993, by Beard et al and now U.S. Pat. No. 5,469,872, and U.S. patent application Ser. No. 08/076,535, filed Jun. 14, 1993, by Conrad and White, now U.S. Pat. No. 5,483,977. The present invention provides an enhanced spool and shell pressure vessel including a construction based on individually replaceable components, and an improved sealing assembly. The present invention can improve operation of the spool, simplify its construction and/or improve the long term reliability thereof, while also improving the ease of replacing worn sealing elements and/or damaged portions of the spool.

A preferred spool sealing assembly according to the present invention includes at least one elastically deformable sealing member, preferably a sealing ring, positioned about the circumferential exterior of the end member for sealing the spool when it is in the treating position within the shell. An annularly shaped axial pressure applying member is operatively associated with the sealing rings to releasably impart axial pressure to the sealing rings when the spool is in the treating position to cause the rings to extrude radially outwardly and thereby accomplish sealing of the spool within the shell. The axial pressure applying member receives fluid pressure from a fluid source, advantageously hydraulic fluid. Preferably, the axial pressure applying member receives fluid pressure from two distinct sources which act upon a compression member to provide axial pressure to the axial surfaces of the elastically deformable sealing ring. More preferably, the axial pressure applying member receives fluid pressure from both a hydraulic fluid and from the processing fluid, e.g., expansion agent, used to treat tobacco carried by the spool.

In another aspect of the present invention, the spool is advantageously formed of a plurality of components including a connecting rod supporting the spool end members on the opposed ends thereof. Each end member is formed from a plurality of discreet, axially removable annular components, the latter including the sealing assemblies. A removable securing member is fixedly connected to one or both ends of the connecting rod to retain the annular sealing assembly components on the radially central connecting rod. With this construction, the annular sealing members can easily be replaced. One preferred component spool includes a radially central connecting rod, having a plurality of axially extending channels formed in its exterior. Annular members forming the spool ends are coaxially positioned on the periphery of the ends of the connecting rod. Radial ports in at least one of the end members are in fluid communication with end portions of the exterior channels formed in the connecting rod surface. A porous, tubular sleeve is positioned around a central portion of the connecting rod between the spool end members and covers the channels. With this construction, high pressure tobacco treatment fluid, preferably expansion agent, can be admitted to the spool interior via the ports in the end member and is then carried to the central tobacco treatment area of the connecting rod, between the end members, by the exterior channels in the connecting rod. The fluid treating agent passes through the porous sleeve to impregnate tobacco packed on the spool body around the porous sleeve. Replacement of worn sealing members can be achieved simply by removal of the retaining members allowing the sealing assemblies to then be easily removed from the main spool body for replacement of the worn sealing rings.

BRIEF DESCRIPTION OF THE DRAWINGS

In the drawings, which form a portion of the original disclosure of the invention.

DETAILED DESCRIPTION OF THE PREFERRED EMBODIMENT

The present invention will now be described more fully in detail with reference to the accompanying drawings, in which the preferred embodiments of the invention are shown. This invention should not, however, be construed as limited to the specific embodiments set forth herein, rather they are provided so that this disclosure will be through and complete and will fully convey the scope of the invention to those skilled in the art.

Figure 1:
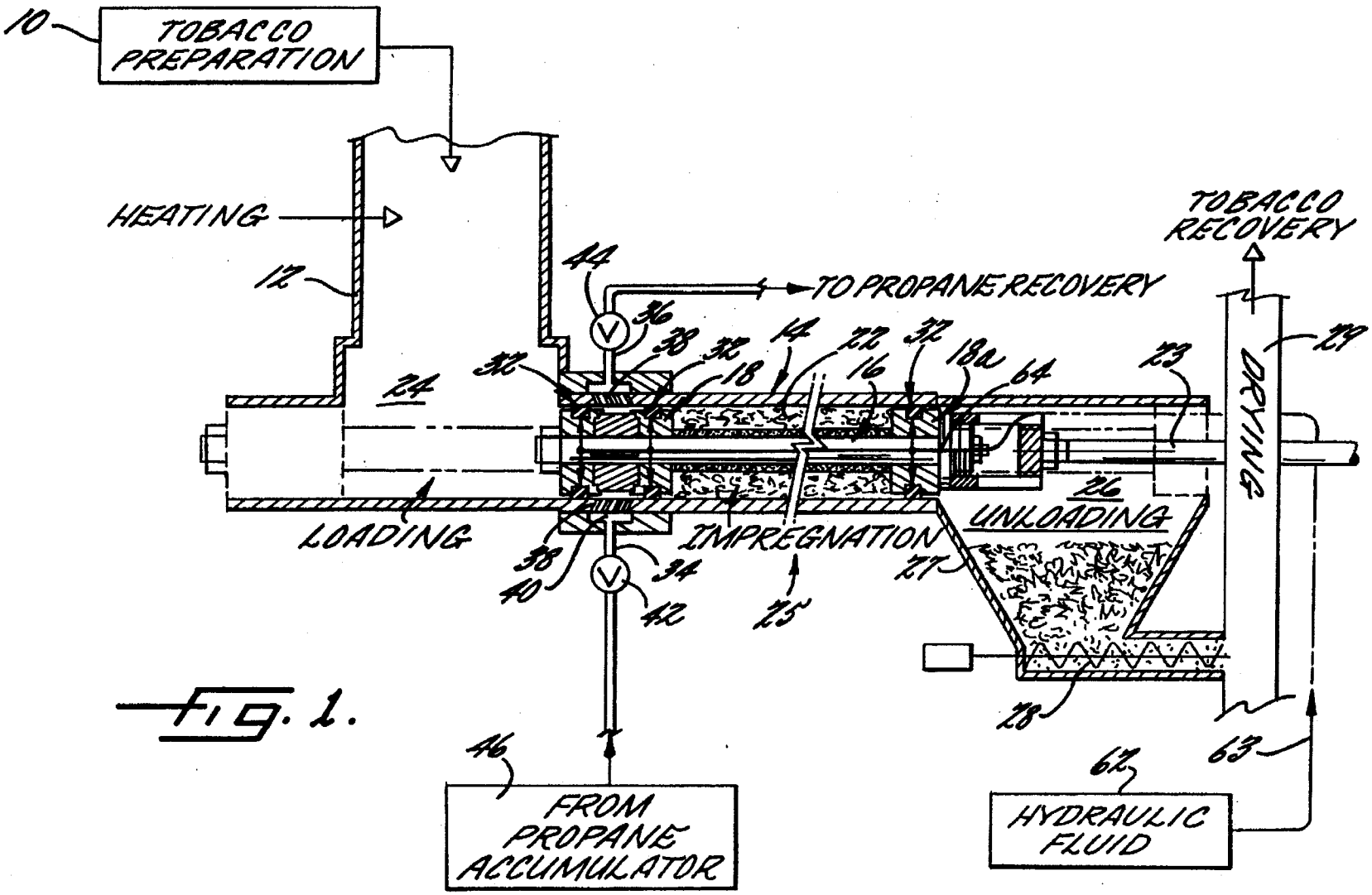
FIG. 1 is a schematic view of one advantageous tobacco expansion system including a preferred embodiment of an improved component spool and shell pressure chamber apparatus according to the present invention.

FIG. 1 is a schematic illustration of one advantageous embodiment of a tobacco expansion system and process which utilizes a preferred spool and shell assembly according to the present invention. The spool and shell apparatus is generally constructed in accordance with U.S. Pat. No. 4,554,932, issued Nov. 26, 1985 to Conrad and White; and pending U.S. patent application Ser. No. 08/163,049 of Beard, et al., filed Dec. 6, 1993, and U.S. patent application Ser. No. 08/076,535 of Conrad and White, filed Jun. 14, 1993, the entire disclosures of which are herein incorporated by reference. Various details disclosed in the above disclosures are not repeated herein for the sake of brevity.

However, reference may be had to the complete disclosures thereof for such details.

In the apparatus of FIG. 1, tobacco is preferably first treated in a single or series of preparation zone(s) 10 to increase its moisture content to a value above about 16% by weight, preferably above about 20% by weight, and also to increase its temperature substantially above ambient temperature. The heated and moistened tobacco is then passed to a feeding zone 12 which defines a loading position for a reciprocating spool and shell high pressure fluid treating apparatus.

The spool and shell high pressure fluid treating apparatus includes the pressure vessel defined by a tubular shell or enclosure 14 and the spool assembly 16. The shell 14 and spool assembly 16 can be made of any suitable materials, including stainless steel and the like. The specific construction and size of the shell and spool will be sufficient to withstand the pressures contemplated within the pressure vessel, as will be apparent.

The spool assembly 16 includes cylindrically shaped end members 18, 18*a* and a connecting rod 20 supporting the end members 18 and 18*a* on its two ends. When the spool 16 is within the shell 14 as illustrated in FIG. 1, the end members 18 and 18*a* together with the connecting rod 20 and the shell 14, define an impregnation zone 22 in the form of an annular space of predetermined volume constituting a sealed pressure chamber or vessel. The spool assembly 16 is arranged for reciprocating movement among a loading position 24, illustrated in phantom, an impregnating position 25 specifically shown in FIG. 1, and an unloading position 26, also illustrated in phantom. A fast acting hydraulic piston or similar motor means (not shown) is axially attached via a shaft 23 partially shown in FIG. 1 for moving the spool 16 among the three positions.

The spool is loaded with tobacco at position 24 prior to being moved to the impregnating position. The tobacco may be loaded onto the spool 16 in the loading position 24 according to the system described in U.S. Pat. No. 4,554,932. In a preferred embodiment, also, the tobacco may be loaded onto the spool 16 by the system set forth and described in U.S. patent application Ser. Nos. 08/163,049 and 08/076,535, previously set forth. Each of these references describe tobacco upstream feeding and loading apparatus to process tobacco in any of various forms, including the form of leaf (including stem and veins), strips (leaf with the stem removed), cigar filler, cigarette cut filler (strips cut or shredded for cigarette making), or the like, preferably cut filler tobacco, as moisturized by means know to those skilled in the art to a moisture content of at least about 13% and preferably at least about 20%. The tobacco is also preferably preheated to a temperature above ambient, and is then loaded onto opposing sides of spool 16, preferably under conditions such that the tobacco is compressed thereon to a density of 125% or greater as compared to the loose fill density of the same tobacco. Advantageously, the tobacco is compressed to a compression ratio of greater than 2:1, up to ratios amounts of 3:1 and greater. Packing densities of 20–35 pounds per cubic foot, calculated based on a moisture content of 12% can be readily employed in the present invention.

Once the tobacco has been loaded at loading position 24, the spool assembly is moved, by shaft 23 to an impregnating position 25 shown in FIG. 1, and the tobacco is impregnated with expansion agent for a short period of time, and the expansion agent is then released. The spool is then moved to the unloading position 26 wherein a pneumatic unloading device such as an oil-free compressor (not shown) directs fluid such as high pressure air or nitrogen onto the tobacco surrounding spool 16. When the expansion agent is propane or a similar expansion agent of the type disclosed in U.S. Pat. No. 4,531,829 to White and Conrad, no heating of the tobacco is necessary in order to cause expansion of the tobacco or to fix the tobacco in expanded form. Thus, the tobacco removed in the unloading position 26 preferably expands substantially instantaneously and as illustrated in FIG. 1, is fed to a recovery chute 27 and then to a conveying apparatus 28, such as a screw conveyor and the like. The moist, expanded tobacco is advantageously then conveyed to a drying zone 29 by conveying apparatus 28 in order to remove excess moisture which might cause the expanded tobacco to partially collapse.

The spool body 16 of the invention, is illustrated in detail in FIGS. 2A–9. In order that the spool 16 be movable within the shell 14, i.e., from a loading position to an impregnating position to an unloading position, it is important that there is a radial gap or clearance 30 (best seen in FIGS. 3A, 3B, 5, 6, 7 and 9) between the inner circumferential surface of the shell and the outermost circumferential surface of the spool 16. When the spool 16 reaches impregnation position 25, the gap 30 is closed by operation of a plurality of sealing assemblies 32, shown generally in FIG. 1 and in detail in FIGS. 2A, 2B, 3A and 3B and discussed below. The sealing assemblies 32 are positioned along the circumferential outer surface of the spool end members 18, 18*a*.

Once the pressure vessel is positioned in the impregnation position 25 and sealed by operation of the sealing assemblies 32, a fluid tobacco expansion agent, preferably propane at a pressure above about 2000 psig and a temperature above about 150 ° F., is fed to and removed from the impregnation zone 22 via high pressure gas supply and exhaust lines 34 and 36, respectively, which communicate through the shell 14 via a plurality of ports 38. These ports, which may be circumferentially distributed about the periphery of the shell 14, allow the introduction and removal of high pressure fluid into and out of the pressure chamber 22 when the spool member 16 is in the impregnation position. An exterior manifold 40 surrounds the ports 38 and contains the processing fluid admitted to the shell 14 via the circumferential ports 38. The high pressure fluid flows through the ports 38 and then into the tobacco loaded and compressed about the spool connecting rod 20 via a plurality of ports and channels in the spool body (described in detail below). The line 38, which is used to remove high pressure fluid from the impregnation zone 22, is connected to an optional gas recovery zone (not shown) for recovery of fluid removed from the impregnation zone.

A pair of fast acting valves 42 and 44 are provided for rapid introduction and release of fluid expansion agent into and out of the impregnating chamber 22. These valves are preferably ball valves having a port size ranging from 0.5 inch to 1.5 inch in diameter or greater depending on the size of the impregnation zone 22 to thereby provide for substantially instantaneous admittance and removal of high pressure fluid to and from the impregnation zone 22. The valves are advantageously automatically opened and closed by fast acting hydraulic actuators, not shown.

On the input side, the high pressure gas line 34 is connected to a high pressure expansion agent supply, preferably an accumulator device 46, such as that discussed in greater detail in U.S patent application Ser. No. 08/63,049 incorporated above, which provides a high pressure impregnation fluid, such as propane, to the impregnation zone in the spool impregnator shown in FIG. 1. The pressure of the propane admitted to the impregnation zone 25 is preferably above 2,000 psig, and more preferably between about 2,500 psig and 3,000 psig. The temperature of the propane is advantageously maintained above 280° F., preferably between about 250° F. and 400° F., e.g., about 300°–315° F. This provides excess sensible heat for heating the tobacco in the impregnation zone. Extremely short impregnation times, between about 5 and about 15 seconds, can be used to impregnate tobacco when these high temperatures and pressures are used, while obtaining extremely desirable increases in tobacco filling capacity, for example, in excess of 50 to 100% increase in filling capacity.

Devices other than accumulator 46 can alternatively be used to provide a substantially immediate delivery of high pressure, high temperature expansion agent. For example, a vessel containing only high density expansion agent maintained above supercritical pressure can also be used. When the vessel contains a relatively large mass of expansion agent compared to the mass of expansion agent removed in each cycle and maintains the expansion agent at a high density, the discharge of the expansion agent from the vessel can be accomplished with only a relatively small pressure drop in the expansion agent.

Returning to FIG. 1, following introduction of expansion agent into the impregnator apparatus, the compressed impregnated tobacco is maintained under impregnated conditions for a short period of time ranging from one to two seconds up to about twenty seconds. Thereafter, the pressure is released by opening valve 44.

Figures 2A, 2B, 3A:
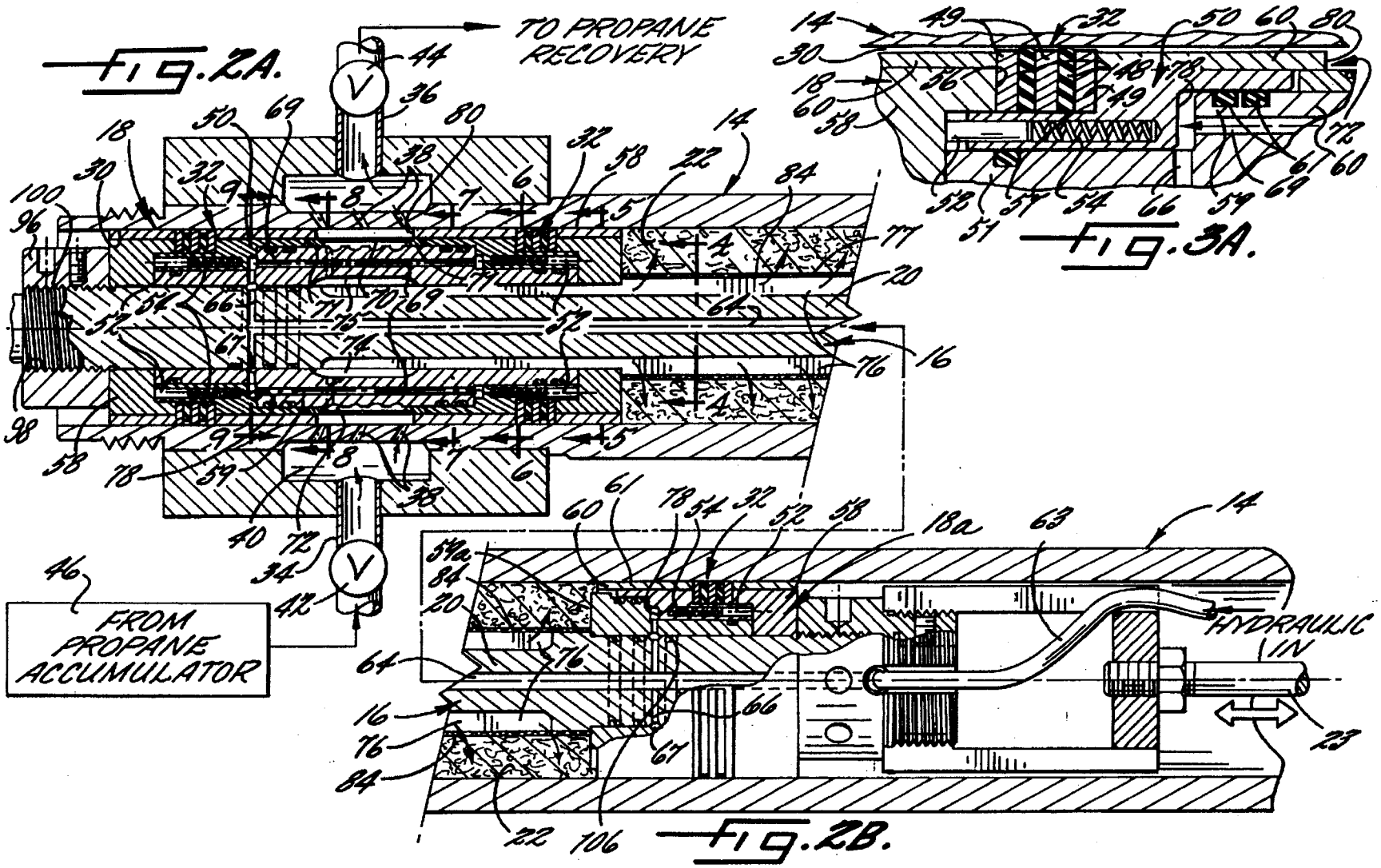
FIGS. 2A and 2B, taken together, illustrate a detailed sectional view, with portions shown in plan view, of the spool and shell assembly of FIG. 1 and illustrate the spool in a treating position within the shell.
FIGS. 3A and 3B are exploded sectional views of preferred sealing assemblies associated with the end members of the spool body shown in FIGS. 2A and 2B, respectively, and illustrate the sealing members in an axially compressed, radially expanded sealing position.
Figure 4:
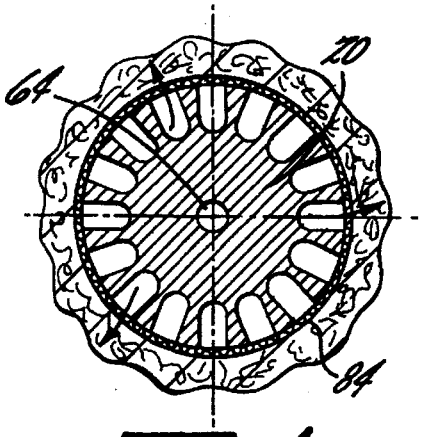
FIG. 4 is an enlarged cross-sectional view taken along line 4—4 of FIG. 2A and illustrating a charge of tobacco within the annular space surrounding the enlarged central portion of the connecting rod of the spool body.

FIGS. 2A, 2B, 3A and 3B illustrate operation of the sealing assemblies 32 for sealing of the spool within the shell 14 during impregnation of tobacco with expansion agent. The sealing assemblies 32 are located on the cylindrical end members 18, 18*a* of the spool 16 as seen in FIGS. 2A and 2B, respectively. In the preferred embodiment, two sealing assemblies 32 are provided on the cylindrical end member 18 through which expansion agent is admitted into the spool, while only a single sealing assembly 32 is located on the other spool end member 18*a*. However, a different number of sealing assemblies may be provided on either or both of the end members 18, 18*a* of the spool 16. Likewise, tobacco expansion agent or other treating agent can be admitted and removed from both ends of the spool if desired, while not departing from the scope of the present invention.

Figure 3B:
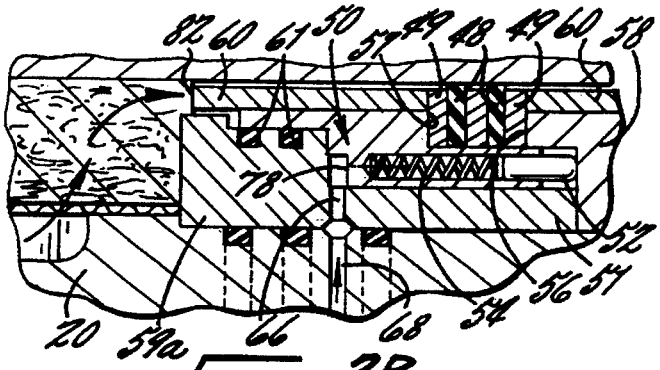
Figure 5:
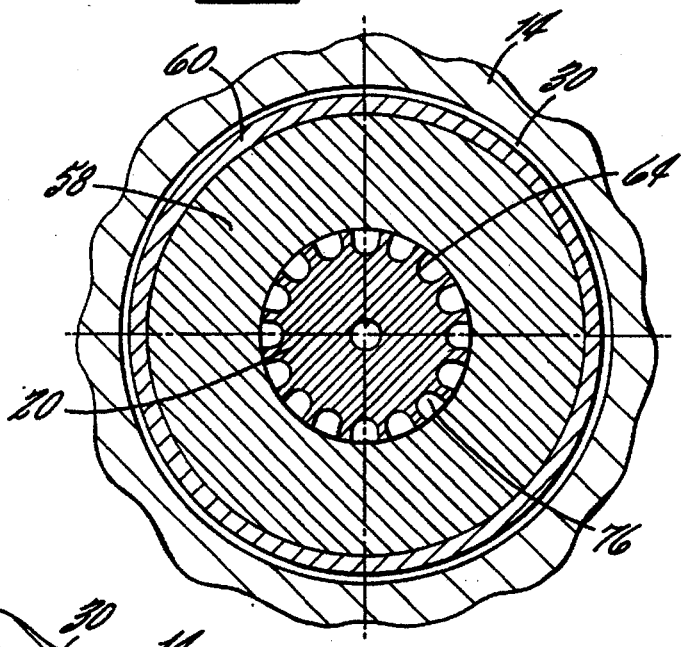
FIG. 5 is an enlarged detailed sectional view taken along line 5—5 of FIG. 2A illustrating a portion of a spool end member positioned within the shell.
Figure 6:
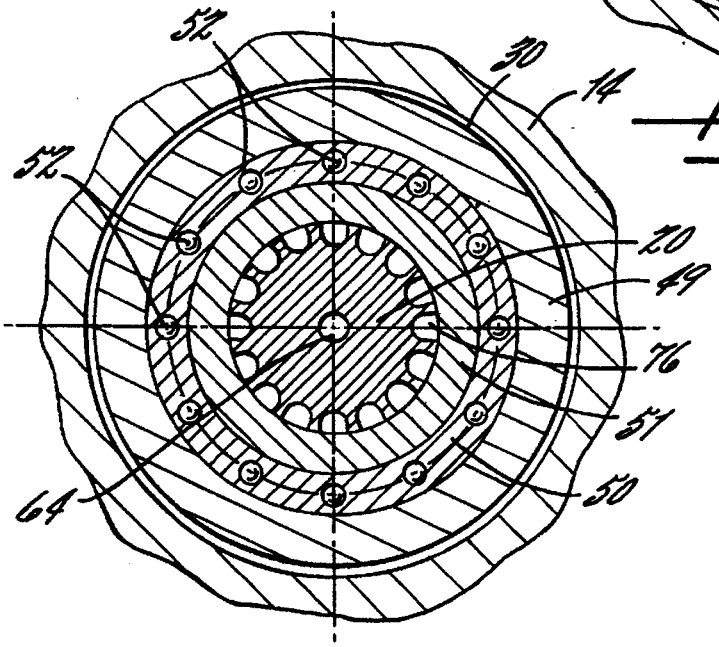
FIG. 6 is an enlarged detailed sectional view taken through the sealing assembly along line 6—6 of FIG. 2A and illustrating a portion of the sealing assembly of the spool end member positioned within the shell.

FIGS. 2A and 2B illustrate the two cylindrical end members 18 and 18*a* of the spool 16 in their impregnating position within the shell 14 and shows the two sealing assemblies 32 of end member 18, and the single sealing member of the end member 18*a*, in a relaxed, non-sealing position. Accordingly, the radial gap 30 (best seen in FIGS. 3A and 3B) between each of the end members and the shell 14 is not sealed. FIGS. 3A and 3B illustrate sealing assemblies in their operative sealing position in which each sealing assembly 32 forms a seal across the radial gap 30.

As best seen in FIGS. 3A and 3B, each annular sealing assembly 32 extends around the circumference of an end member 18, 18*a* and comprises two elastically deformable sealing rings 48 sandwiched between three optional, axially movable spacer rings 49, which are provided to ensure an even application of pressure to the elastically deformable sealing rings 48. An axially movable compression member 50, in the form of a radially stepped, annular member comprising an exterior layer or sleeve (discussed below), is mounted in spaced, coaxial relationship with respect to the connecting rod 20, exterior to the periphery thereof. The compression member 50 is supported on its interior surface by one or more smaller diameter annular sleeves 51, which are preferably integrally formed with a ported annular member 59 discussed below. The smaller diameter annular sleeves 51 are also coaxially mounted on the connecting rod 20, and are axially fixed with respect to the connecting rod 20. A plurality of pins 52 extend into axially oriented cylindrical cavities formed in the compression member 50 and cooperate with springs 54 which are also provided in each of the cylindrical cavities to bias the axially movable compression member 50 in a direction axially away from the sealing members 48. When it is in this position, the compression member 50 applies no or substantially no compression to the sealing member 48 so that the sealing member 48 is maintained in a relaxed, non-sealing position except during operation of the sealing assembly 32.

As shown in FIGS. 3A and 3B each sealing assembly 32 is positioned within an annular cavity in the circumferential exterior of the spool end members 18 and 18*a*. The compression member has an axial length smaller than that of the cavity so that the compression member is axially moveable within the cavity. The sealing members 48 and the spacer rings 49 are positioned axially between an axial end face 56 of an axially fixed annular abutment member 58 which forms one end of the cavity, and an axial end face 57 of the compression member 50 which is moveable axially within the cavity to apply pressure to the sealing rings 48.

As seen in FIGS. 2A and 2B, the construction of the spool end member 18 differs from the opposing end member 18*a* of the spool 16. The end member 18 shown in FIG. 2A comprises two axially fixed annular abutment members or rings 58 which are positioned on opposing axial ends of a ported annular member 59 which is axially fixed with respect to the central connecting rod 20. Thus, the annular cavities supporting the sealing assemblies 32 in the circumferential exterior of the spool end member 18 are each substantially defined between an axial end face 56 of an abutment ring 58, and one of the opposing end faces of the ported annular member 59.

FIG. 2B illustrates the other cylindrical end member 18*a* of the spool 16 which supports only one sealing assembly 32, one axially movable compression member 50, and one annular abutment member 58. The ported annular member 59*a* of spool end 18*a* is substantially shorter in the axial direction as compared to ported annular member 59 of spool end 18. As discussed below, the ported annular member 59 of spool end 18 contains a substantially increased number of ports as compared to annular member 59*a* and includes one set of ports for admitting tobacco expansion agent and another set of ports for admitting hydraulic fluid while the ports in ported annular member 59*a* admit only hydraulic fluid.

As best seen in FIGS. 3A, 3B, 5, and 7, an exterior sleeve 60 formed of a relatively soft metallic material, preferably a lead-free bearing alloy such as aluminum-bronze alloy, is removably attached by shrink fitting, to the outside of each of the abutment members 58 and each of the compression members 50. This protects the interior surface of shell from being damaged by scraping as the spool 16 slides repetitively back and forth between the loading position 24, the impregnating position 25, and the unloading position 26. The bearing alloy can be applied to the exterior of only the annular abutment members 58, or only to the exterior of the compression members 50 provided in each of the end members 18, 18*a*. Alternatively, the annular abutment members 58, and/or the compression members 50 can be formed entirely of, or can be coated on their exterior circumferential surface with a bearing alloy or another metal or material which is softer than the metal forming the shell 14. Thus the abutment members 58 can be formed of bronze, aluminum bronze or another lead-free bearing alloy, or the like, or can be coated, e.g., by sputter coating, with such materials. In addition, or alternatively, the spacer rings 49 can be constructed of or coated with a bearing alloy or another relatively soft metal to thereby alternatively or also provide a wearable bearing surface around a portion of the end members 18 and 18*a*.

In one advantageous embodiment (not shown) the exterior sleeves 60, best seen in FIGS. 3A and 3B, can be formed integrally with those spacer rings 49 which are positioned between the compression member 50 and the sealing ring 48, or between the abutment member 50 and the sealing ring 48. Thus, referring to FIG. 3A, the sleeve 60 shown on the right side of the two sealing rings 48 can be formed integrally with the spacer ring 49 shown on the right side of the two sealing rings 48 to form a composite sleeve and spacer ring structure having an L-shaped longitudinal cross-section. Similarly, in the assembly shown in FIG. 3B, the sleeve 60 shown on the left side of the two sealing rings 48, can be formed integrally with the spacer ring 49 shown on the left side of the two sealing rings 48 to also form a composite ring having an L-shaped longitudinal cross-section. If desired, the sleeve and spacer ring composite can be formed integrally with the corresponding pressure member 50, and/or the corresponding abutment member 58. In one preferred embodiment, the abutment members 58, their corresponding sleeves 60 and their adjacent spacer rings 49 are formed in each sealing assembly as an integral structure from a bearing alloy; however, in the case of the compression members 50 in each sealing assembly, L-shaped longitudinal cross-sectional members constituting the combination of the sleeve 60 and the spacer ring 49 are used in combination with the compression members 50 shown in FIGS. 3A and 3B. It will be apparent from the foregoing, that the spacer rings can be eliminated if desired and/or formed integrally with the corresponding abutment members or with the corresponding compression members.

The sealing rings 48 can be formed of any of various high temperature stable, resiliently deformable materials as are used to form sealing rings, including carbon and graphite based materials commercially available as GRAFOIL. In one preferred embodiment the sealing rings can be formed of an EDPM elastomer having a durometer hardness of between about 70 and 90, most preferably 80.

The spacer rings 49 are advantageously positioned immediately adjacent to, and in sufficient number to contact both axial end faces of each elastically deformable sealing ring 48. The spacer rings 49 can be bonded to the elastically deformable sealing rings 48 by adhesive bonding, vulcanization processes or the like, but are preferably separate from the sealing rings 48 in order to simplify replacement of worn sealing rings. It is also preferred that the spacer rings 49 be coated, at least on the axial end surface or surfaces contacting the sealing ring 48, with a "release" coating, such as chromium plating, or the like, to prevent the spacer rings 49 from sticking to the sealing rings 48, thus further simplifying replacement of worn sealing rings.

Figure 7:
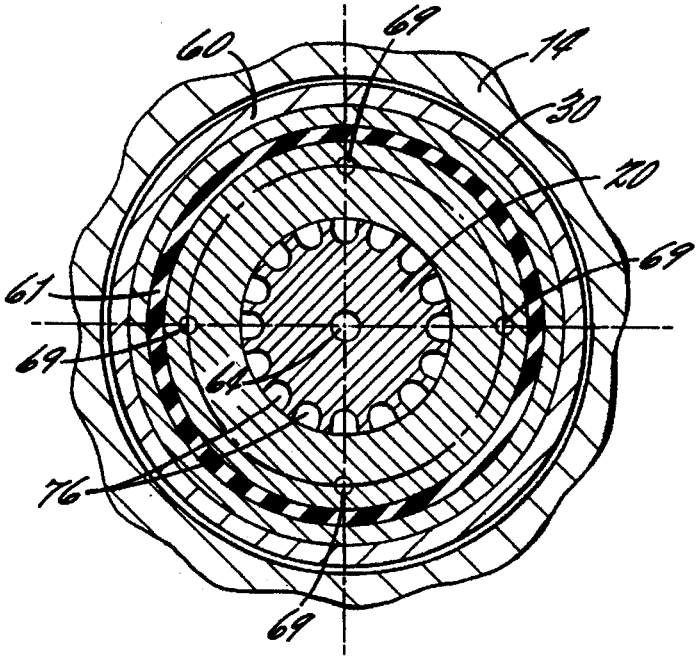
FIG. 7 is an enlarged detailed sectional view taken along line 7—7 of FIG. 2A illustrating another portion of the spool end member positioned within the shell.

As best seen in FIGS. 3A, 3B and 7, annular o-ring seals 61 are provided in the annular cavities supporting the sealing assemblies 32 in the circumferential exterior of the spool end members 18 and 18*a*, adjacent the axially sliding lower surfaces thereof. The o-ring seals 61 assist in maintaining fluid separation, i.e., to prevent mixing, between the plural pressurizing fluids used to axially move each compression member 50, as discussed below, particularly in the vicinity of the moving surfaces of the compression member that slide against other spool end member surfaces.

Each sealing assembly 32 is actuated by application of fluid pressure by two separate fluids on separate axial surfaces of the compression member 50. The first fluid is preferably a hydraulic fluid such as food grade oil, or a similar high temperature stable pressure application fluid. The hydraulic fluid is provided at a predetermined elevated fluid pressure from a high pressure fluid supply 62 (FIG. 1) which can be a conventional hydraulic accumulator, a hydraulic ram, or the like. As best seen in FIG. 2B, the hydraulic fluid is forced through a supply line 63 into an axial channel 64 centrally located in the connecting rod 20. The hydraulic fluid flows axially through the port 64 in the connecting rod 20 in the direction from spool end 18*a* then towards the spool end 18 (FIG. 2A).

Figure 9:
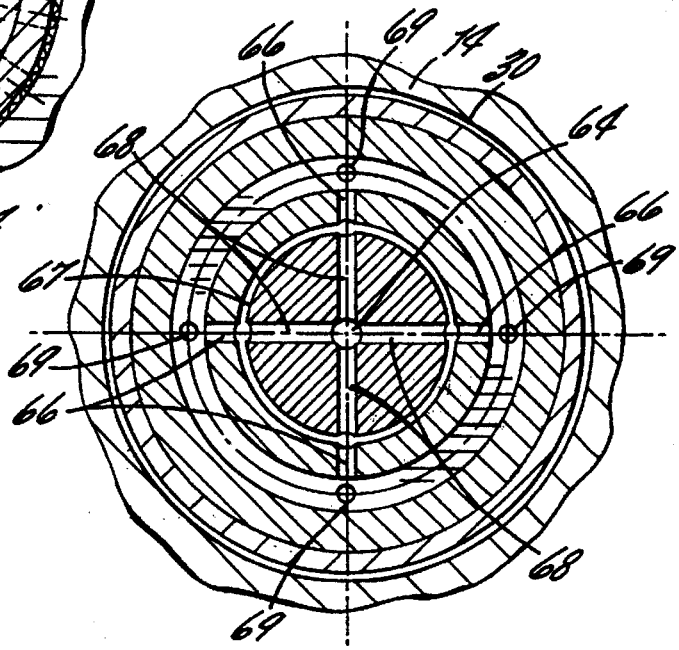
FIG. 9 is an enlarged detailed sectional view taken along line 9—9 of FIG. 2B and illustrates radial ports through the end member and through the connecting rod for providing hydraulic fluid to the compression members of the sealing assembly, and also illustrates an annular space for providing improved fluid communication between these ports even when the ports are not aligned with each other, allowing hydraulic fluid to provide axial force on the compression member for operation of the sealing assembly.

A plurality of radially extending fluid ports 66 (FIGS. 2A, 2B, 3A, 3B and 9) are formed in each of the ported annular members 59 and 59*a* associated with spool ends 18 and 18*a*, respectively. The radial ports 66 are fluidly connected at their interior ends to the axial port 64 via an annular cavity 67 in the connecting rod and a plurality of radial ports 68 extending into the connecting rod 20 and communicating between the annular cavity 67 and the axial port 64 as seen in FIG. 9. Each of the radial ports 66 in the annular members 59 and 59*a* receive a portion of the hydraulic fluid flowing through the axial channel 64. At their exterior ends, the radial channels 66 are fluidly connected to a plurality of circumferentially distributed axial ports 69 (FIGS. 2A and 9), which extend axially through the ported annular member 59 in end member 18. The hydraulic fluid which exits the radial ports 66 extending into the ported annular members 59 and 59*a* is applied to, and contacts one axial end portion of each compression member 50 as further discussed below.

Figure 8:
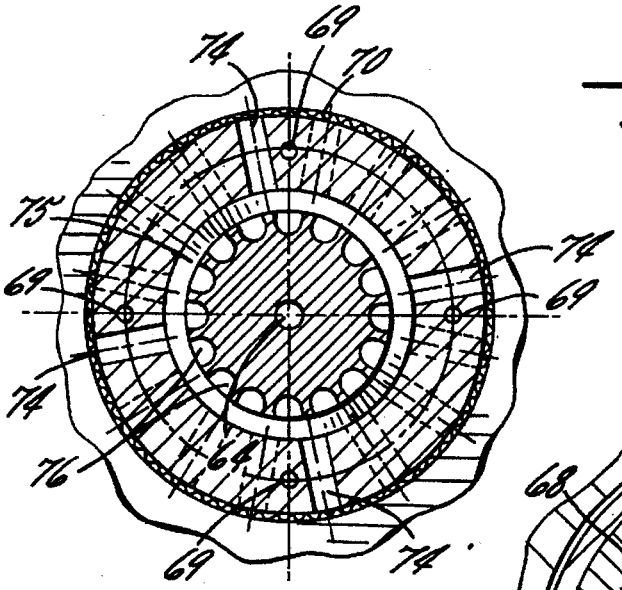
FIG. 8 is an enlarged detailed sectional view taken along line 8—8 of FIG. 2A illustrating radial ports in the spool end member for admitting and removing tobacco treating fluid and which terminate in an annular space communicating with the axial channels formed on the surface of the connecting rod.

The second fluid used to apply fluid pressure to the compression member 50 is preferably the expansion agent used to impregnate the tobacco to cause expansion thereof. FIGS. 2A and 8 illustrates a preferred port arrangement through the spool 16 for distributing the high pressure expansion agent to the compression members 50 and also to the tobacco in impregnation zone 22. The expansion agent supplied by high pressure gas line 34 is delivered through the shell 14 to the spool body 16 via a plurality of ports 38 through the shell. The expansion agent then passes across a porous sleeve 70, which prevents any tobacco particles clinging to the shell 14 from entering into the spool body. In one preferred embodiment, the porous sleeve 70 has a thickness of about 1/16 inch and is formed by thermally fusing three wound layers of a 10 micron mesh stainless steel screen. The porous sleeve 70 is supported at its two axial ends by stainless steel rings 71. After passing through the porous sleeve 70, the expansion agent enters into an annular space 72 which surrounds ported annular member 59 on spool end 18. The expansion agent passes from annular space 72 into a plurality of radially oriented ports 74 (FIGS. 2A and 8) extending into the ported annular member 59 of spool end 18.

As best seen in FIGS. 2A and 8, the radial ports 74 are fluidly connected at their interior ends with an annular cavity 75 on the inside periphery of ported annular member 59. In turn, the annular cavity 75 communicates with a plurality of axial channels 76 formed in the exterior periphery of the connecting rod 20. The axial channels 76, in turn, extend from the ported annular member B9 toward the spool end member 18*a*, as seen in FIGS. 2A and 2B. The portion of the connecting rod 20 located between the two spool end members 18 and 18*a* has a greater exterior diameter than the axial end portions of the connecting rod associated with each end member 18 and 18*a*. As best seen in FIG. 2A, the depth of the channels 76 in this central portion of the connecting rod is thus greater than the depth of the channels 76 in the portion of the connecting rod associated with the end member 18.

As the expansion agent flows along the channels 76 formed in the surface of connecting rod 20, the expansion agent passes radially outwardly through a diffuser sleeve 84, surrounding the central, larger diameter portion of the connecting rod, and then into the tobacco loaded and compressed into the impregnation zone 22 of the spool body as indicated by the arrows in FIGS. 2A, 2B, 3B and 4. The diffuser sleeve is advantageously formed of any of various porous materials such as ceramics, sintered metals, and the like and is preferably a porous or aperatured metallic sleeve. One preferred sleeve has a thickness of about 1/16 inch and is formed by thermally fusing three layers of a 10 micron mesh stainless steel screen which have been wound onto each other. The diffuser sleeve 84 is annular and completely encircles the channels 76 thereby allowing expansion agent to pass into the tobacco for impregnation thereof while preventing tobacco from entering into and possibly obstructing the channels 76 in the connecting rod 20.

The operation of the sealing assemblies 32 is best seen with reference to FIGS. 3A and 3B. The sealing assemblies are initially activated by the high pressure hydraulic fluid which is delivered through the ports 66 in ported annular members 59 and 59*a*. As the hydraulic fluid exits the ports 66 it applies fluid pressure against a first axial end surface 78 of the axially movable compression member 50 causing the compression member to move axially towards, and apply axial pressure to the spacer rings 49 and the elastically deformable sealing rings 48. In turn, the sealing rings 48 extrude radially outwardly to form a pressure seal across the radial gap 30 between exterior of the end member 18 and the inside surface of the tubular shell 14.

At a time either simultaneous with, or just subsequently to the introduction of the pressurized hydraulic fluid into the spool 16, the valve 42 (FIG. 2A) is opened to deliver propane expansion agent from the accumulator device 46 to the annular space 72 surrounding ported annular member 59. As seen in FIGS. 2A and 3A, a second axial end surface 80 of each axially movable compression member 50 on spool end 18, is positioned adjacent to and defines portion of the axial end of the annular space 72. Accordingly, the high pressure expansion agent supplied to the annular space 72 applies axial pressure to the second axial end surface 80 of each axially movable compression member 50 on spool end 18 causing additional fluid pressure to be applied axially to the compression member 50.

As illustrated in FIG. 3B the sealing assembly 32 on end member 18*a*, operates substantially the same as the sealing assemblies on end member 18. However, the second axial surface 82 of the axially movable compression member 50 on end member 18*a* is in fluid communication with the impregnation zone 22 containing the tobacco and thus receives fluid pressure from the expansion agent admitted into the impregnation zone 22. In the remaining aspects, however, the sealing assembly 32 on end member 18*a* operates the same as those on end member 18 shown in FIGS. 2A and 3.

Thus, the two pressurized fluids apply a pressure axially onto the two separate axial end surfaces 78 and 80 of the axially movable compression members 50 of end member 18 and to the two axial end surfaces 78 and 82 of the compression member 50 of end member 18*a*. The fluid pressure added by the expansion agent on the axial end surface 80 of the compression member 50, causes the spacer rings 49 compress against the sealing members 48 with greater force so that the strength of the pressure seal formed by the sealing members in the radial gap 30 is increased. In a preferred embodiment, a clearance between the spool 16 and the shell 14 of 0.003–0.006 inches is provided to allow movement of the spool 16 within the shell 14 while also allowing proper sealing of the radial gap 30 by the sealing assemblies 32.

Once the tobacco has been impregnated under predetermined conditions for a predetermined amount of time, the first and second pressurized fluids are removed from the spool body via hydraulic line 63 and high pressure gas line 38, respectively. This in turn removes the axial pressure from the axial end surfaces 78 and 80, 82 of the axially movable compression members 50 which thereby removes the axial pressure from the spacer rings 49 permitting the sealing rings 48 to assume a non-compressed, relaxed position. To prevent dragging of the sealing members 48 and assist in release of the seals, the springs 54 further ensures that axially movable compression member 50 resumes its original position as illustrated in FIGS. 2A and 2B.

While the sealing assemblies illustrated in the Figures comprise three spacer rings 49 and two sealing rings 48, it is within the scope of this invention that only one sealing ring 48 in each sealing assembly 32 may be utilized. Furthermore, although each sealing ring 48 is shown with a spacer ring 49 on both sides thereof, it is also within the scope of this invention that only one spacer ring 49 be provided and furthermore, that no annular spacer ring be used so that the sealing member 48 is compressed by direct contact with the compression member 50 and the axial end face 56 of the cavity in the end member.

In the preferred embodiment of the invention shown in the drawings, the spool assembly 16 is constructed from a plurality of component parts allowing for less costly construction and repair of the spool 16. Advantageously, the spool assembly components include a connecting rod 20 which supports the end members 18 and 18*a* on the opposed ends thereof. The end members are formed from a plurality of annular members or sleeves, i.e., annular members 58 and 59, each supported coaxially on one end portion of the rod 20. The shoulders at the two ends of the enlarged diameter central portion of the connecting rod 20, seen in FIGS. 2A, 2B, and 4, each function as an axial stop for preventing the annular members which form the end members 18 and 18*a* on the opposed end portions of the connecting rod 20, from moving axially onto the central portion of the connecting rod 20. Various alternative axial stops can be substituted for the enlarged central portion of the connecting rod 20, such as, for example, mechanical locking members forming protrusions on the connecting rod, an sleeve formed of a structural material coaxially positioned about the axially central portion of the connecting rod, or the like, as will be apparent.

A removable securing member such as locking nut 96, shown in FIG. 2A, is secured to the rod 20 at one or both ends thereof to removably secure the annular elements of the spool assembly 16 on the rod 20. Thus, the locking nut 96 can be removed from the end of the rod to allow for repair or replacement of one or more elements of the spool assembly. This minimizes downtime of the apparatus due to mechanical failures and provides increased cost savings such as when only one component requires repair or replacement. In a preferred embodiment, the securing element 96 comprises threads 98 which mate with matching threads 100 associated with the rod 20. Preferably, a plurality of o-ring sealing members 106 are provided on the connecting rod in order to safeguard the integrity of the processing fluids, i.e., the hydraulic fluid and the tobacco expansion agent.

The various aspects of the tobacco expansion processes described herein have been discussed specifically in connection with the use of propane as an expansion promoting impregnation agent and the use of impregnation temperature conditions near or above supercritical temperature together with conditions of elevated pressure approaching or above supercritical pressure, and in connection with preferred apparatus. It will be apparent that the processes and apparatus of the invention can be varied by numerous changes; for example, where recovery of expansion agent such as propane is not desired, the expansion agent can be burned following use thereof. In addition various significant tobacco expansion processes and apparatus disclosed herein, although particularly suited to tobacco expansion processes and apparatus employing high density expansion agent at supercritical temperatures and using short impregnation times, are also considered applicable to a wide variety of other differing tobacco expansion processes, expansion fluids, and apparatus.

Tobacco filling capacities when referred to herein, are measured in the normal manner using an electronically automated filling capacity meter in which a solid piston, 3.625 inches in diameter, is slidably positioned in a similarly sized cylinder and exerts a pressure of 2.6 lbs. per sq. in. for 5 seconds on a tobacco sample located in the cylinder. These parameters are believed to simulate the packing conditions to which tobacco is subjected in cigarette making apparatus during the formation of a cigarette rod. Measured tobacco samples having a weight of 50 g are used for expanded tobacco. Samples having a weight of 100 g are used for unexpanded tobacco.

The invention has been described in considerable detail with reference to preferred embodiments. However many changes, variations, and modifications can be made without departing from the spirit and scope of the invention as described in the foregoing specification and defined in the appended claims.

That which is claimed is:

1. A spool and shell assembly for use in tobacco expansion comprising:

a pressure vessel defined by a tubular shell and a spool assembly moveable between at least a first position outside the shell and a treating position within the shell;

said spool assembly comprising first and second cylindrical end members and a connecting rod extending therebetween;

at least one sealing assembly carried by each of said first and second end members for sealing said pressure vessel when said spool is in the treating position;

each of said sealing assemblies comprising at least one elastically deformable annular sealing member associated with the circumferential exterior of said end member for sealing said spool in the treating position;

a pressure applying member operatively associated with each of said sealing members for releasably imparting axial pressure on said sealing members when said spool assembly is in said treating position to cause radial expansion thereof; and a hydraulic fluid port in each of said spool end members, said hydraulic fluid port being fluidly connected to said pressure applying member to cause hydraulic fluid to apply fluid pressure axially to said pressure applying member.

2. A spool and shell assembly according to claim 1 wherein said pressure applying member comprises an annular shaped member positioned axially adjacent said sealing member.

3. A spool and shell assembly according to claim 2 comprising at least one spacer ring positioned axially between said pressure applying member and said sealing member.

4. A spool and shell assembly according to claim 2 wherein said pressure member positioned axially adjacent said sealing member is in axial contact with said sealing member.

5. A spool and shell assembly according to claim 3 additionally comprising at least one port in at least one of said end members for admitting tobacco expansion agent into said end member, said fluid port being fluidly connected to said pressure applying member to cause said expansion agent to apply additional fluid pressure axially to said pressure applying member.

6. A spool and shell assembly according to claim 5 wherein said hydraulic fluid imparts fluid pressure onto a first axial end portion of said pressure applying member and said expansion agent imparts fluid pressure onto a second axial end portion of said pressure applying member.

7. A spool and shell assembly according to claim 2 wherein each of said spool end members comprises at least one annular abutment member positioned adjacent said sealing assembly.

8. A spool and shell assembly according to claim 2 wherein a plurality of sealing assemblies are carried by at least one of said spool end members.

9. A spool and shell assembly according to claim 2 wherein said pressure applying member is axially movable between a first relaxed position and a second position exerting axial force against the sealing member.

10. A spool and shell assembly according to claim 9 further comprising a biasing member positioned to bias said axially movable compression member in said first relaxed position.

11. A spool and shell assembly for use in tobacco expansion processes comprising:

a pressure vessel including a tubular shell and a spool assembly;

said spool assembly comprising first and second cylindrical end members and a connecting rod extending therebetween;

first and second fluid supplies for supplying at least two distinct pressurized fluids into said pressure vessel;

a sealing assembly operatively associated with each of said spool end members for sealing said pressure vessel, said sealing assembly comprising at least one annular compression member and at least one annular elastically deformable sealing member, said annular compression member being positioned in operative association with an axial end surface of said sealing member and being arranged for axial movement relative to said sealing member; and said first and second fluid supplies being fluidly connected with said spool assembly to apply fluid pressure to separate axial end portions of said axially movable compression member to cause said compression member to apply axial force to said sealing member.

12. A spool and shell assembly according to claim 11 wherein said first fluid supply supplies hydraulic fluid to said spool assembly.

13. A spool and shell assembly according to claim 12 wherein said second fluid supply supplies a tobacco expansion agent to said spool assembly.

14. A spool and shell assembly according to claim 13 wherein said spool assembly is moveable between at least a first position outside the shell and a treating position within the shell.

15. A spool and shell assembly according to claim 14 wherein said spool is loaded with tobacco in said first position outside the shell and wherein said tobacco is contacted with said expansion agent when said spool is in said treating position within the shell.

16. A component spool assembly for use in tobacco expansion processes comprising:

a connecting rod supporting first and second cylindrical end members on opposed ends thereof, each of said first and second end members comprising a plurality of discreet annular members including at least one sealing assembly wherein each of said sealing assemblies comprises at least one elastically deformable annular sealing member associated with the circumferential exterior of one of said end members and an axially movable compression member adapted to exert axial force on at least a portion of said sealing member to produce radial expansion of a circumferentially exterior portion of said deformable sealing member;

an axial stop associated with each axial end of a central portion of the connecting rod between the spool end members for preventing axial access by said annular members to said central portion of said connecting rod; and a removable securing member connected to at least one end of the connecting rod to retain the annular members forming said spool ends on the connecting rod.

17. A component spool and shell assembly according to claim 16 wherein said central portion of the connecting rod between the spool end members has an enlarged diameter to thereby form said axial stops.

18. A process of expanding tobacco utilizing a pressure vessel including a tubular shell and a spool assembly comprising a connecting rod supporting two end members on the opposed ends thereof, each end member including at least one elastically deformable sealing member, said process comprising the steps of:

loading tobacco on a portion of the spool assembly between the end members;

moving the spool assembly to a treating position within the shell;

supplying a pressurized hydraulic fluid to each of said end members to apply axial compression force to each of the sealing members and thereby cause said sealing members to expand radially and provide a sealed pressure vessel in said shell between the end members of the spool;

impregnating the tobacco with an expansion agent; and releasing the axial force applied to said sealing members.

19. A process according to claim 18 further comprising the step of applying additional axial force to each of the sealing members by supplying a portion of said expansion agent under pressure to a portion of each of said spool end members operatively arranged to receive axial fluid pressure from said expansion agent and to apply axial force to said sealing members.

* * * * *